United States Patent [19]

Bainton

[11] 4,364,158

[45] Dec. 21, 1982

[54] ROLL BENDING APPARATUS

[75] Inventor: Herbert W. Bainton, Woodbridge, Conn.

[73] Assignee: USM Corporation, Farmington, Conn.

[21] Appl. No.: 182,875

[22] Filed: Sep. 2, 1980

[51] Int. Cl.[3] ..... B21B 13/14

[52] U.S. Cl. ..... 29/116 AD

[58] Field of Search ..... 29/113 AD, 116 AD

[56] References Cited

FOREIGN PATENT DOCUMENTS 47-7221 4/1972 Japan ..... 29/116 AD 588277 1/1978 U.S.S.R. ..... 29/116 AD

*Primary Examiner*—Eugene F. Desmond

*Attorney, Agent, or Firm*—Vincent A. White

[57] ABSTRACT

An arrangement for bending of a roll in a calender roll machine, to produce a crown in the roll, while minimizing any increased or decreased load on the bearing thereduring. The roll bending arrangement includes a sleeve assembly on each end thereof, which are each given a couple. The roll bending apparatus producing each couple is secured to the foundation or the frame of the machine so as to minimize any additional load on the roll bearings which carry the nip pressure.

2 Claims, 4 Drawing Figures

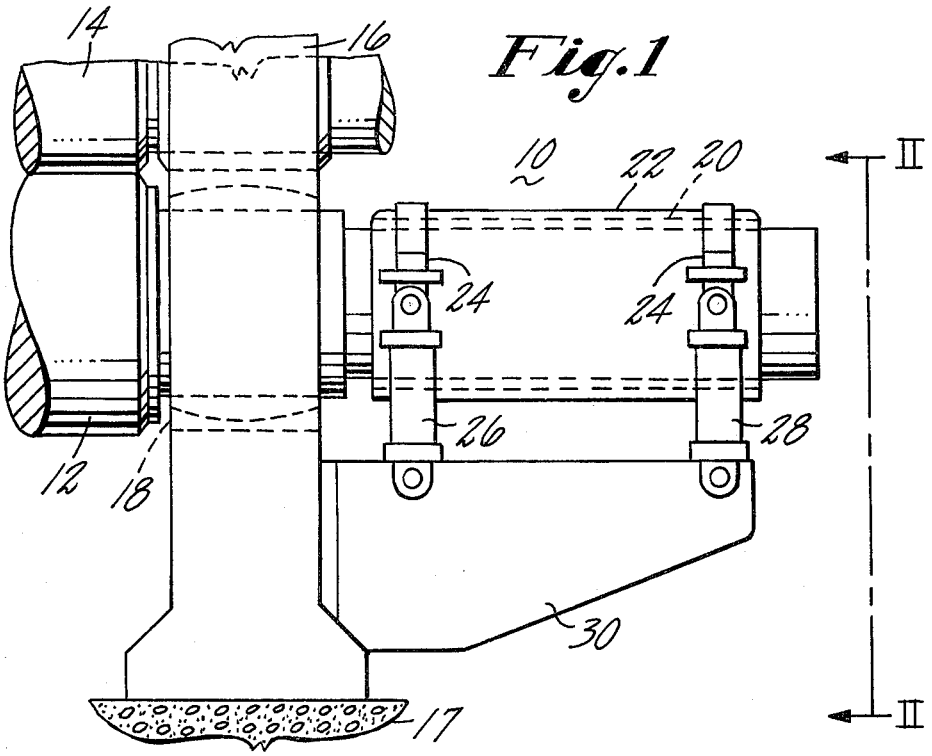
Fig.1
Fig.2
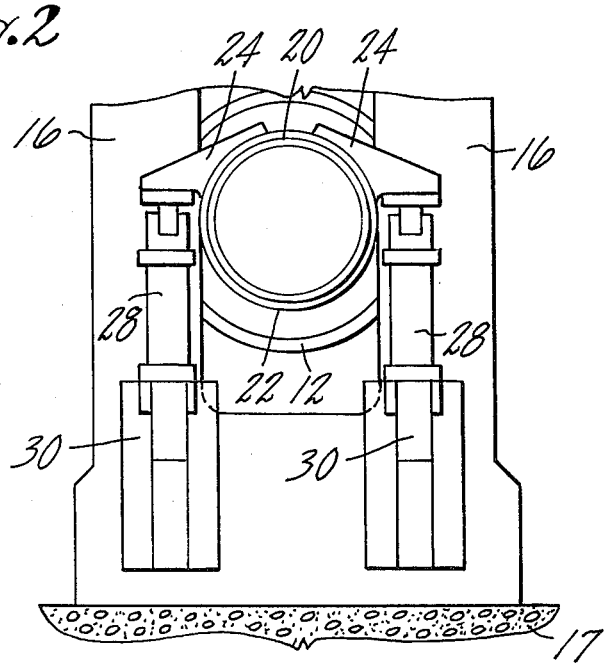

44
46
40
48
52
50
54
60
62
64
66
56
42
45
IV
IV 44
46
58
52
50
54
42
56
66
45
46

ROLL BENDING APPARATUS

BACKGROUND OF THE INVENTION

1. Field of the Invention

This invention relates to calender roll machines, and more particularly to apparatus to effect bending forces within a roll in said machine.

2. Prior Art

Bending of rolls in calender roll machines has been done for many years in order to create a constant line of pressure over the entire width of a roll gap in a wide line pressure range. These conditions are required by paper mills, textile mills, web plastic manufacturers and other industries, because non-uniform line pressures in the nip or pressing gap can easily reduce the quality of the product flowing therefrom, and can impair the productivity of the machines. It is difficult to maintain these uniform gap conditions because of varying loads on the roll and supporting bearings. If resultant forces on these components are to be controlled, they can cause the cost and complexity of the components to escalate considerably. A number of attempts have been tried to control roll bending. One is shown in U.S. Pat. No. 4,068,360 to Frueler wherein fluid pressure is supplied to support devices within the roll, and piston and cylinder units press in a direction normal to the roll to effect bending therein. U.S. Pat. No. 4,030,177 to Hold discloses deflection correction by piston and cylinder units effecting a moment arm around the roll bearings, utilizing sensors which trigger the external bending of an inner shaft to counter any deflection of the external roll. The piston and cylinder units are located either between the bearings or distally arranged therewith. U.S. Pat. No. 3,543,365 to Helminen shows a web stretching device wherein a portion of the roll axis is pivoted about its support bearings.

Though these prior devices have counter deflected shafts or rolls, they appreciably increase the loading on the equipment and thus they pay a price in necessarily heavy bearings, excessive bearing wear and the need for frequent replacement thereof.

Thus it is an object of the present invention to provide roll bending apparatus which will minimize additional loading on the roll bearings.

It is a further object of the present invention to provide a roll bending apparatus that will permit a change in the nip condition of a roll by the application of a couple to each end of the roll.

BRIEF SUMMARY OF THE INVENTION

The present invention involves roll bending apparatus disposed on the shaft of a calender roll. The bending apparatus comprises a sleeve disposed about each roll end, each sleeve having bearing means, wherein a couple may be applied to the sleeve inducing only a minimal additional load on the bearings of the roll. The biasing means may be secured to the frame of the calender roll machine or it may be secured to its foundation, permitting the pure couple to be effected therein without disturbing the bearing load. The bending apparatus may include pressurizable cylinders arranged in a spaced manner on each side of the sleeve, or spaced cylinders, disposed on a shaft to transmit the couple to the sleeve from the pressurizable cylinders.

BRIEF DESCRIPTION OF THE DRAWINGS

The objects and advantages of the present invention will become more apparent when viewed in conjunction with the following drawings, in which:

FIG. 1 is a side view of one embodiment of the bending apparatus constructed according to the principles of the present invention;

FIG. 2 is a view taken along the lines II–II of FIG. 1;

DESCRIPTION OF THE PREFERRED EMBODIMENTS

Figure 3:
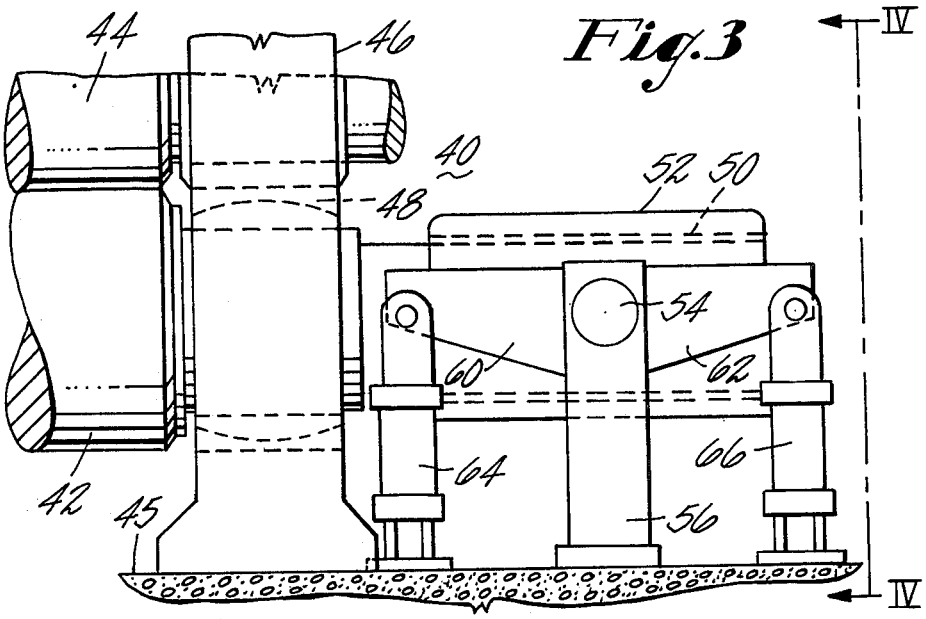
FIG. 3 is a side view of a second embodiment of the bending apparatus constructed according to the principles of the present invention.

Referring now to the drawings in detail, and particularly to FIG. 1, there is shown in a side view, a portion of a calender roll machine 10 in a first embodiment having a rotatable lower roll 12 and a rotatable upper roll 14 journalled in a frame 16 of the calender roll machine 10, only one side of the rolls 12 and 14 and the frame 16, being shown. The frame 16 is mounted on a foundation 17. The lower roll 12 is journalled in a proper bearing 18, which bearing 18 permits slight pivotal motion within the rotatable lower roll 12 with respect to the frame 16. Each distal portion of the lower roll 12 has a bushing 20 disposed therearound. The bushing 20 is enclosed within a cylindrically shaped sleeve 22. The sleeve 22 has a pair of lugs 24, spaced a horizontal distance apart, on each side thereof. A first pair of double acting pressurizable piston and cylinder units 26 are pivotally connected to the lugs 24 closest to the frame 16. A second pair of double acting pressurizable piston and cylinder units 28 are pivotally connected on the sleeve 22 to the lugs 24 furthest from the frame 16, as shown in FIGS. 1 and 2. All of the piston and cylinder units 26 and 28 in this embodiment pivotally connected at their other end, to a heavy bracket 30 which fixedly extends off of the frame 16.

The first and second pairs of pressurizable piston and cylinder units 26 and 28 are regulatably pressurizable by proper pressure regulating means, not shown. The lower and upper rolls 12 and 14 are rotatively empowered by proper means, not shown.

During operations of the calender roll machine 10, when it is desired to change the nip to insure a constant gap between the lower and upper rolls 12 and 14, it is necessary to apply a bend in the lower roll 12, and it is desirable to do that without additionally loading the bearings 18. The bend in the lower roll 12 in this embodiment is thus induced by generating a couple at each end of the lower roll 12, which has the effect of bending the lower roll 12 in or near the middle by directing a downward force at the ends of the lower roll 12, and an upward force on the roll 12 at a location somewhat inwardly of the downward force. Thus, in FIG. 1, the first pair of piston and cylinder units 26 would be pressurized to effect an upward force on the lower roll 12, and the second pair of piston and cylinder units 28 would be pressurized to effect a downward force on the distal portions lower roll 12. The stresses generated by the first and second pairs of pressurizable cylinders 26 and 28 would be transmitted by the brackets 30 and borne by the frame 16 of the calender roll 10, and to the foundation 17 to which it is mounted, thereby minimizing any additional load on the bearings 18 themselves.

Figure 4:
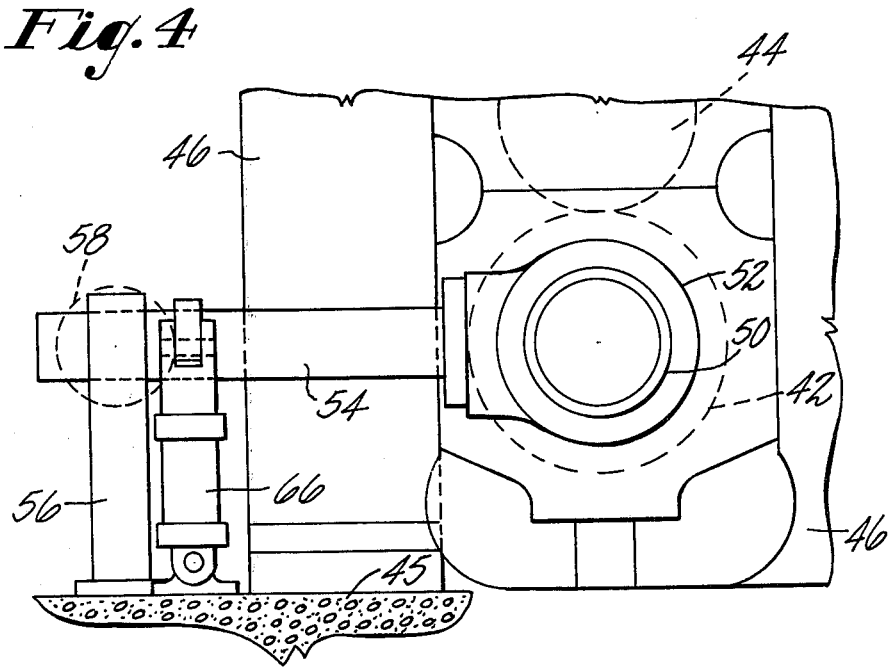
FIG. 4 is a view taken along the lines IV—IV of FIG. 3.

A second embodiment, as shown in FIGS. 3 and 4, includes a calender roll machine 40 having rotatable lower and upper rolls 42 and 44 journalled in a frame 46 of the calender roll machine 40 mounted on a foundation 45. The lower roll 42 is journalled in a proper bearing 48, which bearing 48 permits a slight pivotal motion with respect to the frame 46. Each distal portion of the roll 42 has a bushing 50 disposed therearound. The bushing 50 is enclosed within a cylindrically shaped sleeve 52. An arm 54 is secured to one side of the sleeve 52 and extends through a support post 56 with which it is journalled, by a bearing 58. A first and a second lever 60 and 62 are secured to the arm 54 and extend therefrom, parallel to the lower roll 42. A first and a second double acting pressurizable piston and cylinder unit 64 and 66 is each pivotally attached to each distal end of the levers 60 and 62 respectively. The other end of the piston and cylinder units 64 and 66 are pivotally secured to the foundation 45. The pressurizable piston and cylinder units 64 and 66 are regulatably pressurizable by proper regulatable pressure means, not shown. The rolls 42 and 44 which are rotatively driven by proper means, are not shown.

The roll bending apparatus of this embodiment is operated in a manner similar to that described in the first embodiment. When it is desired to correct the gap between adjacent rolls 42 and 44, an upward bend in the lower or upper roll if it had similar apparatus thereattached, is effected by inducing a couple about the arm 54. That is, by pressurizing the first piston and cylinder unit 64 to direct an upward force in the first lever 60 and by pressurizing the second piston and cylinder unit 66 to effect a downward force in the second lever 62. The first and second levers 60 and 62 transmit the couple through the arm 54 into the sleeve 52, inducing the upward bend in the middle of the roll 12, without adding any appreciable load or strain to the bearings 48. The piston and cylinder units of this invention, could be replaced of course, by gearing units to accomplish the same result.

It is to be noted that either embodiment may be utilized to promote a downward bend, if one were desired, in whichever shaft the bending apparatus were connected.

Thus there has been shown a roll bending apparatus for a calender roll machine, wherein the gap between adjacent rolls can be corrected to uniformity by regulatable couple generating means while minimizing any additional load or strain on the roll bearings, thus extending the machine useful life and capabilities of the machine.

I claim:

1. A roll bending apparatus for a calender roll machine comprising: a roll journaled in bearings pivotable in frames to accommodate bending of the roll, means acting on at least one end of the roll for inducing a couple to bend the roll carried by the bearings, the couple inducing means comprising a pair of pressurizable piston and cylinder units each pivotally secured at one end to the frame and pivotally secured at the other end to a bushing on said roll end, the units being adapted to apply oppositely directed forces to effect the couple on the roll without adding any appreciable load to said bearings.

2. A roll bending apparatus according to claim 1 in which the bushing is provided with a shaft having a two armed lever, the piston and cylinder units each being secured at one end to a foundation carrying the frame and at the other end to one of the arms of the lever.

* * * * *